US008915199B2

(12) United States Patent
Bohlig et al.

(10) Patent No.: US 8,915,199 B2
(45) Date of Patent: Dec. 23, 2014

(54) PROCESS FOR COGASIFYING AND COFIRING ENGINEERED FUEL WITH COAL

(75) Inventors: James W. Bohlig, Rutland, VT (US); Dingrong Bai, Rutland, VT (US)

(73) Assignee: Accordant Energy, LLC, Rutland, VT (US)

( * ) Notice: Subject to any disclaimer, the term of this patent is extended or adjusted under 35 U.S.C. 154(b) by 240 days.

(21) Appl. No.: 13/453,791

(22) Filed: Apr. 23, 2012

(65) Prior Publication Data

US 2012/0266793 A1 Oct. 25, 2012

Related U.S. Application Data

(60) Provisional application No. 61/478,089, filed on Apr. 22, 2011.

(51) Int. Cl.

| | |
|---|---|
| ***F23B 90/00*** | (2011.01) |
| ***F23G 7/10*** | (2006.01) |
| ***F23G 5/14*** | (2006.01) |
| ***F23G 5/027*** | (2006.01) |

(52) U.S. Cl.

CPC *F23G 5/027* (2013.01); *F23G 7/10* (2013.01); *F23G 5/14* (2013.01); *F23G 2204/101* (2013.01)

USPC ..... 110/342; 110/229; 110/233; 110/262

(58) Field of Classification Search

CPC ..... F23G 5/027; F23G 5/14; F23G 7/10; F23G 2204/101; F23J 7/00; C04B 18/065; F23K 1/00; F23K 2201/505; C10L 9/10

USPC ..... 110/342, 218, 229, 234, 235, 341, 211, 110/214, 216, 243, 245, 246, 344, 345, 346, 110/233, 262; 48/209, 197 R, 210

See application file for complete search history.

(56) References Cited

U.S. PATENT DOCUMENTS

| | | | | |
|---|---|---|---|---|
| 6,883,444 | B2 * | 4/2005 | Logan et al. | 110/345 |
| 2002/0095866 | A1 | 7/2002 | Hassett | |
| 2003/0106266 | A1 * | 6/2003 | Bryan et al. | 48/197 FM |
| 2008/0282889 | A1 | 11/2008 | Boardman et al. | |
| 2009/0020456 | A1 | 1/2009 | Tsangaris et al. | |
| 2009/0078175 | A1 * | 3/2009 | Eiteneer et al. | 110/210 |
| 2009/0120384 | A1 * | 5/2009 | Yang et al. | 122/4 D |
| 2011/0099890 | A1 | 5/2011 | Bohlig et al. | |

OTHER PUBLICATIONS

International Search Report for International Application No. PCT/US2012/034691, dated Oct. 26, 2012, 3 pages.

Written Opinion for International Application No. PCT/US2012/034691, dated Oct. 22, 2013, 6 pages.

M. Sami, et al., "Co-Firing of Coal and Biomass Fuel Blends", Progress in Energy and Combustion Science 27 (2001) 171-214.

* cited by examiner

*Primary Examiner* — Kenneth Rinehart
*Assistant Examiner* — Bao D Nguyen
(74) *Attorney, Agent, or Firm* — Cooley LLP

(57) ABSTRACT

Described is an integrated process of cogasifying an engineered fuel, formulated to be suitable for working under reducing environment, with coal and cofiring another engineered fuel, formulated to be suitable for working under oxidizing environment, with coal to produce electric power.

26 Claims, 6 Drawing Sheets

PROCESS FOR COGASIFYING AND COFIRING ENGINEERED FUEL WITH COAL

CROSS-REFERENCE TO RELATED APPLICATIONS

This application claims priority to U.S. provisional application Ser. No. 61/478,089 filed on Apr. 22, 2011, the entirety of which is incorporated herein by reference.

TECHNICAL FIELD

The present invention generally relates to cofiring biomass or waste derived fuels with fossil fuels in commercial, industrial, and utility boilers.

BACKGROUND

As recently as 2009, the combustion of fossil fuels provided almost 70% of the electric power in the US, among which coal provided almost half of the total power generation. Given the unforeseeable uncertainty and often turbulence in oil-producing geopolitical areas, it is projected that coal, which has abundant reserves in the United States, would continue to be a dominant fuel for use in electricity generation in the US and other coal-rich regions. Unfortunately, most US coal-fired power plants are over 40-50 years old, and are not equipped with modern and advanced emission control technologies such as flue gas desulfurization (FGD) for SOx removal and selective catalytic reduction (SCR) for NOx reduction. As such, the air pollution emissions accompanying the coal combustion such as SOx, NOx, $CO_2$, and particulates are significant, increasingly causing public health and environment concerns. As a result, Federal and state regulations regarding the emission of air pollutants have recently become more stringent. For example, the newly finalized Cross State Air Pollution Rule (CSAPR) requires the reduction of power plant emissions in 28 states and the District of Columbia. This—rule would require significant reductions in sulfur dioxide ($SO_2$) and nitrogen oxides (NOx) emissions. It requires that by 2014, applicable power plants must reduce their $SO_2$ and NOx emissions to the unit specific allocated levels. On average, all affected units will have to reduce an $SO_2$ by 73 percent and NOx emissions by 54 percent of 2005 levels.

As a result of increasingly stringent regulations, it is anticipated that flue gas desulfurization (FGD) and selective catalytic reduction (SCR) technologies, which are considered the most effective technologies for SOx and NOx emission controls, will be installed in the future years. These post-combustion emission control technologies are expected to cost hundreds of millions of dollars to install and multimillions of dollars to operate and service every year. As some power producing utilities, especially those having mid or low capacities (such as <100-200 MW), have already faced significant pressure from low profit margins, it is not unreasonable to assume that these utilities may simply elect to retire or de-rate their units for economical and environmental considerations.

While installation of FGD and SCR can help utilities to meet their obligations for $SO_2$ and NOx emissions, they have to deal with some other unwanted consequences, including increased parasitic power consumptions, water utilization, and waste generation. Moreover, for power plants that use high sulfur coals, these technologies have an unintended side effect, i.e. making $SO_3$ related corrosion and "blue plume" issues more prevalent.

As one of the less-expensive alternatives, cofiring of coal and biomass fuel blends has gained popularity with the electric utilities producers. Recent studies in Europe and the United States (see M. Sami, K, Annamalai and M. Wooldridge, "Cofiring of coal and biomass fuel bleeds," Process in Energy and Combustion Science, 27, pp. 171-214, 2001, incorporated by reference) have established that burning biomass with fossil fuels has a positive impact both on the environment and the economics of power generation. The emissions of $SO_2$ and NOx were reduced in most cofiring tests (depending upon the biomass fuel used), and the $CO_2$ net production was also inherently lower, because biomass is considered $CO_2$-neutral. The interest for cofiring arose in the 80's in the U.S. and Europe, around specifically to the use of waste solid residues (paper, plastic, solvents, tars, etc.) or biomass in coal power stations that were initially designed for combustion of coal solely, in order to increase benefit margins from those new opportunity fuels such as reductions in greenhouse gas (GHG) emissions.

Traditionally, biomass has been cofired either directly or indirectly, depending on fuel feeding methods used for both biomass and coal. The most straightforward and cost effective direct cofiring approach is supplying the premixed biomass and coal through a common mill, common feed line and burn with a common burner. Alternatively, in another direct cofiring approach, the biomass can be milled and supplied separately but would be mixed before it is delivered to the burner. Both methods are relatively inexpensive due to shared fuel processing, delivery and combustion equipments, but limited by the amount of biomass blend ratio to typically 5% for pulverized coal (PC) boiler and 10-20% for cyclone and fluidized bed boilers. These direct cofiring approaches also have an insignificant effect upon combustion process and therefore the existing burner can be co-used. Direct cofiring can also be achieved by having a separate biomass processing, delivery line and a dedicated burner. This third direct cofiring method has the advantage of better control over the biomass flow rate, and can achieve higher cofiring ratio (10% or higher for PC boilers, and 20% or higher for cyclone and fluidized bed units) than the previous two direct cofiring methods, but requires a separate feed line and separate burners, and thus increases capital and O&M costs. Furthermore, firing low heating value biomass independently of coal often represents a significant challenge in coordinating controls of both biomass and coal combustions, leading to a risk of poor combustion efficiency.

Indirect cofiring refers to processes in which the biomass fuel is supplied to a separately installed combustor, boiler or gasifier. For example, a separate boiler may be installed to generate steam from firing 100% biomass, and mix the boiler-generated steam with steam generated from an existing coal-fired boiler burning 100% coal. Alternatively, a separate combustor may be installed to fire 100% biomass, and the high temperature flue gas is sent to the convection zone for the existing coal-fired boiler. In yet another alternative and more environmental friendly method, a gasifier is used to gasify the biomass in a separate gasifier, which can be downdraft, updraft or fluidized bed, and the produced hydrogen and carbon monoxide rich synthesis gas (syngas) is supplied to and combusted in the existing coal-fired boiler. The advantages of these indirect cofiring technologies are independent control of operation. However, the capital cost is usually high. In addition, firing coal and biomass fuel in two separate units does not help minimizing or solving the issues with respect to their individual applications. For example, when biomass fuel is fired independently, there is increased corrosion due to high chlorine and alkali metals content in the fuel, though sulfur oxides emission may be low. The ash fusion temperature is also significantly low, which not only cause bed slagging, but also fouling on low temperature heat transfer surfaces. Consequently, it is common that biomass fired boiler generally operates at significantly low temperature, generating low temperature and low pressure steam (e.g. 650 psig and 750° F.), which ultimately leads to a lower electrical efficiency. On the other hand, when coal is fired independently, high temperature and longer reaction time is needed to achieve a higher carbon conversion. At high temperatures, not only sulfur and chlorine corrosion becomes increasingly serious, but also requires expensive materials for boiler and heat transfer surface. High temperature of coal fired boiler makes furnace injection of sorbent for emission control difficult, because of high degree of sorbent sintering and short reaction time achievable.

SUMMARY OF THE INVENTION

Figure 1:
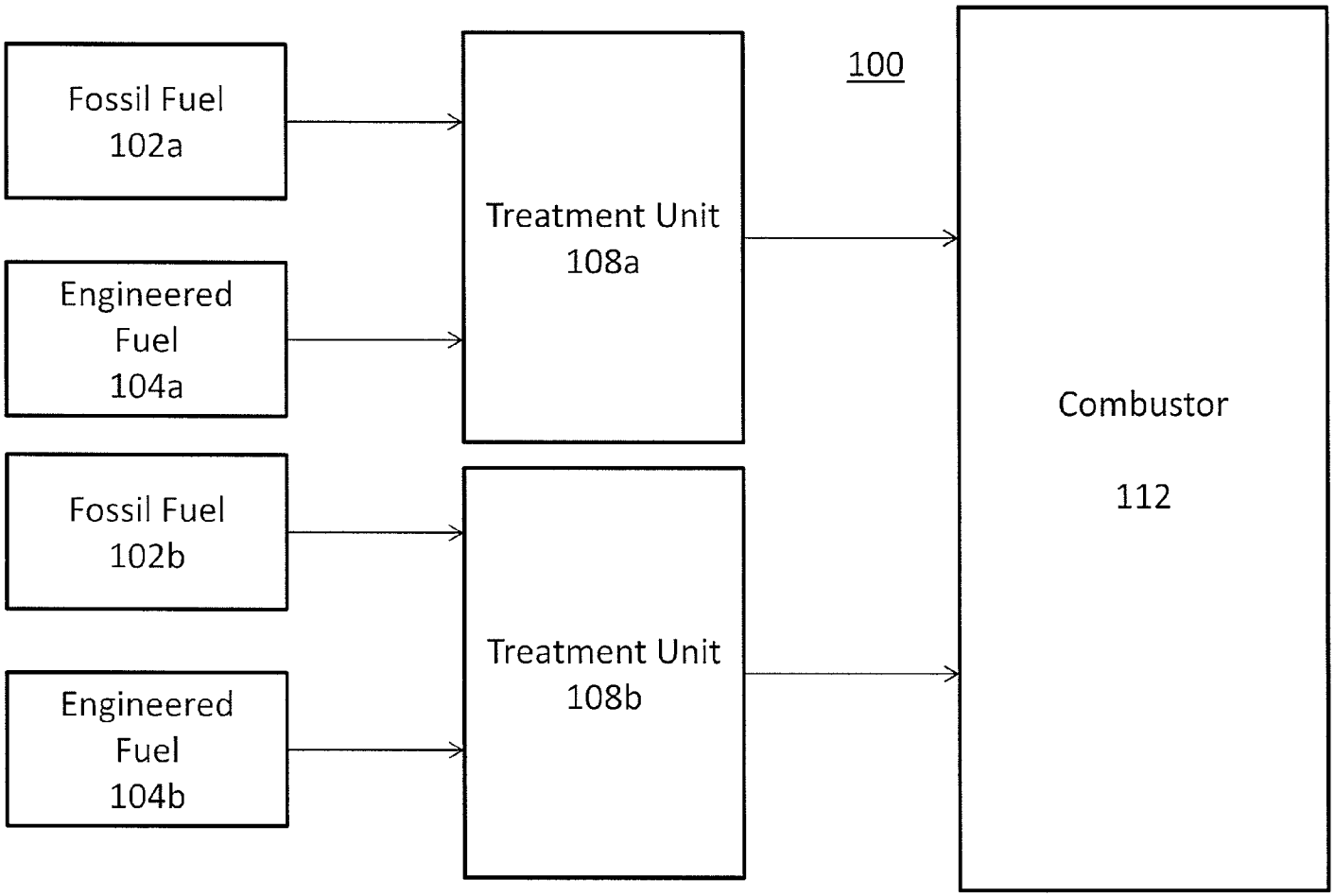
FIG. 1 is a block diagram of a combustion system of some embodiments of the invention.

The present invention provides apparatus and methods of combustion systems for cofiring an engineered fuel and a fossil fuel. In some embodiments, the present invention provides an integrated method of a combustion system comprises introducing a first engineered fuel and a first fossil fuel into a gasifier. The method further comprises cogasifying the first engineered fuel and the first fossil fuel to produce syngas. The method further comprises introducing a second engineered fuel, a second fossil fuel and the produced syngas into a combustion reactor. The method also comprises cofiring the second engineered fuel, the second fossil fuel, and the produced syngas.

In some embodiments, the first engineered fuel is different from the second engineered fuel. In some embodiments, the first engineered fuel is optimized for burning in a reducing environment, and the second engineered fuel is optimized for burning in an oxidizing environment. In some embodiments, the combustor is a boiler, and cofiring further comprises: combusting the second engineered fuel and the second fossil fuel in a combustion zone of the boiler, and combusting the syngas in a reburn zone of the boiler. In some embodiments, the cofiring step comprises one of direct cofiring and indirect cofiring.

In some embodiments, at least one of the first engineered fuel and the second engineered fuel comprises one or more sorbents. The one or more sorbents are selected from the group consisting of sodium sesquicarbonate (Trona), sodium bicarbonate, sodium carbonate, zinc ferrite, zinc copper ferrite, zinc titanate, copper ferrite aluminate, copper aluminate, copper managanese oxide, nickel supported on alumina, zinc oxide, iron oxide, copper, copper (I) oxide, copper (II) oxide, limestone, lime, Fe, FeO, $Fe_2O_3$, $Fe_3O_4$, iron filings, $CaCO_3$, $Ca(OH)_2$, $CaCO_3.MgO$, $CaMg_2(CH_3COO)_6$, silica, alumina, china clay, kaolinite, bauxite, emathlite, attapulgite, coal ash, egg shells, Ca-montmorillonite, and organic salts such as calcium magnesium acetate (CMA), calcium acetate (CA), calcium formate (CF), calcium benzoate (CB), calcium propionate (CP), and magnesium acetate (MA), and mixtures thereof.

In some embodiments, the fossil fuel comprises one or more variety of coal. The one or more variety of coal is selected from the group consisting of: anthracite, lignite, bituminous coal, and mixtures thereof.

In some embodiments, the present invention provides an integrated method for varying an overall cofiring ratio of a combustion system. The method comprises introducing a first engineered fuel and a first fossil fuel into a gasifier at a first cofiring ratio. The method also comprises cogasifying the first engineered fuel and the first fossil fuel to produce syngas. The method also comprises introducing a second engineered fuel and a second fossil fuel into a combustor at a second cofiring ratio. The method also comprises introducing the produced syngas into the combustor, and cofiring the second engineered fuel, the second fossil fuel, and the produced syngas. The method also comprises varying the overall cofiring ratio of combustion by varying an input characteristic of at least two of the first engineered fuel, the first fossil fuel, the second engineered fuel, and the second fossil fuel, wherein the first cofiring ratio and the second cofiring ratio are substantially unchanged.

In some embodiments, the varied input characteristic is one of weight, weight per unit time, heat value, and heat value per unit time. In some embodiments, the overall cofiring ratio is in a range from about 10% to about 50%. In some embodiments, the second cofiring ratio is in a range from about 5 to about 20% less than about 1% to about 5%. In some embodiments, the first cofiring ratio is in a range from about 30% to about 70%. In some embodiments, the fossil fuel comprises one or more variety of coal. In some embodiments, the one or more variety of coal are selected from the group consisting of: anthracite, lignite, bituminous coal, and mixtures thereof. In some embodiments, the first engineered fuel is optimized for burning in a reducing environment, and where the second engineered fuel is optimized for burning in an oxidizing environment. In some embodiments, at least one of the first engineered fuel and the second engineered fuel comprises one or more sorbents. In some embodiments, the one or more sorbents are selected from the group consisting of sodium sesquicarbonate (Trona), sodium bicarbonate, sodium carbonate, zinc ferrite, zinc copper ferrite, zinc titanate, copper ferrite aluminate, copper aluminate, copper managanese oxide, nickel supported on alumina, zinc oxide, iron oxide, copper, copper (I) oxide, copper (II) oxide, limestone, lime, Fe, FeO, $Fe_2O_3$, $Fe_3O_4$, iron filings, $CaCO_3$, $Ca(OH)_2$, $CaCO_3 \cdot MgO$, $CaMg_2(CH_3COO)_6$, silica, alumina, china clay, kaolinite, bauxite, emathlite, attapulgite, coal ash, egg shells, Ca-montmorillonite, organic salts such as calcium magnesium acetate (CMA), calcium acetate (CA), calcium formate (CF), calcium benzoate (CB), calcium propionate (CP), and magnesium acetate (MA), and mixtures thereof. In some embodiments, the first engineered fuel comprises one or more sorbents, and said cogasifying is carried out at a temperature above the sintering temperature of the one or more sorbents. In some embodiments, the cofiring step comprises one of direct cofiring and indirect cofiring. In some embodiments, the combustor is a boiler, and cofiring comprises: combusting the second engineered fuel and the second fossil fuel in a combustion zone of the boiler; and combusting the syngas in a reburn zone of the boiler.

In some embodiments, the present invention provides a combustion system that comprises a gasifier for receiving a first engineered fuel and a first fossil fuel at a first cofiring ratio, said gasifier operable for cogasifying the first engineered fuel and the first fossil fuel to produce syngas. The system also comprises a combustor for receiving a second engineered fuel and a second fossil fuel at a second cofiring ratio, said combustor further receiving the syngas from the gasifier, said combustor operable for cofiring the second engineered fuel, the second fossil fuel, and the produced syngas. The combustion system is operable to vary an overall cofiring ratio of the combustion system by varying an input characteristic of at least two of the first engineered fuel, the first fossil fuel, the second engineered fuel, and the second fossil fuel, where the first cofiring ratio and the second cofiring ratio are substantially unchanged.

In some embodiments, the varied input characteristic is one of weight, weight per unit time, heat value, and heat value per unit time. In some embodiments, the overall cofiring ratio is in a range from about 10% to about 50%. In some embodiments, the second cofiring ratio is in a range from about 5% to about 20%. In some embodiments, the first cofiring ratio is in a range from about 30% to about 70%. In some embodiments, the fossil fuel comprises one or more variety of coal. In some embodiments, the one or more variety of coal is selected from the group consisting of: anthracite, lignite, bituminuous coal and mixtures thereof. In some embodiments, the first engineered fuel is optimized for burning in a reducing environment, and where the second engineered fuel is optimized for burning in an oxidizing environment. In some embodiments, at least one of the first engineered fuel and the second engineered fuel comprises one or more sorbents. In some embodiments, the one or more sorbents is selected from the group consisting of sodium sesquicarbonate (Trona), sodium bicarbonate, sodium carbonate, zinc ferrite, zinc copper ferrite, zinc titanate, copper ferrite aluminate, copper aluminate, copper managanese oxide, nickel supported on alumina, zinc oxide, iron oxide, copper, copper (I) oxide, copper (II) oxide, limestone, lime, Fe, FeO, Fe2O3, Fe3O4, iron filings, CaCO3, Ca(OH)2, CaCO3·MgO, CaMg2(CH3COO)6, silica, alumina, china clay, kaolinite, bauxite, emathlite, attapulgite, coal ash, egg shells, Ca-montmorillonite, organic salts such as calcium magnesium acetate (CMA), calcium acetate (CA), calcium formate (CF), calcium benzoate (CB), calcium propionate (CP), and magnesium acetate, and mixtures thereof. In some embodiments, the first engineered fuel comprises one or more sorbents, and the gasifier carries out the cogasifying at a temperature above the sintering temperature of the one or more sorbents. In some embodiments, the combustor may be directly or indirectly cofired.

In some embodiments, the present invention provides an integrated method of a combustion system that comprises introducing a first engineered fuel and a first fossil fuel into a cofiring unit. The method also comprises cofiring the first engineered fuel and the first fossil fuel to produce syngas. The method also comprises introducing a second engineered fuel, a second fossil fuel and the produced syngas into a combustion reactor. The method also comprises cofiring the second engineered fuel, the second fossil fuel, and the produced syngas.

In some embodiments, the first cofiring unit is selected from: a gasifier, a combustor, and a boiler. In some embodiments, the first cofiring unit is a combustor or a boiler, the combustor or boiler comprising a bed zone operated in a reducing environment. In some embodiments, the syngas is completely or incompletely combusted. In some embodiments, the first engineered fuel is different from the second engineered fuel. In some embodiments, the first engineered fuel is optimized for burning in a reducing environment, and wherein the second engineered fuel is optimized for burning in an oxidizing environment. In some embodiments, the combustor is a boiler, and cofiring comprises: combusting the second engineered fuel and the second fossil fuel in a combustion zone of the boiler; and combusting the syngas in a reburn zone of the boiler. In some embodiments, the cofiring step comprises one of direct cofiring and indirect cofiring. In some embodiments, at least one of the first engineered fuel and the second engineered fuel comprises one or more sorbents. In some embodiments, the one or more sorbents are selected from the group consisting of sodium sesquicarbonate (Trona), sodium bicarbonate, sodium carbonate, zinc ferrite, zinc copper ferrite, zinc titanate, copper ferrite aluminate, copper aluminate, copper managanese oxide, nickel supported on alumina, zinc oxide, iron oxide, copper, copper (I) oxide, copper (II) oxide, limestone, lime, Fe, FeO, Fe2O3, Fe3O4, iron filings, CaCO3, Ca(OH)2, CaCO3·MgO, CaMg2(CH3COO)6, silica, alumina, china clay, kaolinite, bauxite, emathlite, attapulgite, coal ash, egg shells, Ca-montmorillonite, calcium magnesium acetate, calcium acetate, calcium formate, calcium benzoate, calcium propionate, and magnesium acetate, and mixtures thereof. In some embodiments, the fossil fuel comprises one or more variety of coal. In some embodiments, the one or more variety of coal is selected from the group consisting of: anthracite, lignite, bituminous coal, and mixtures thereof.

DESCRIPTION OF THE INVENTION

The following specification and non-limiting examples further illustrate the present invention in greater detail.

Definitions

As used herein, the verb "comprise" as is used in this description and in the claims and its conjugations are used in its non-limiting sense to mean that items following the word are included, but items not specifically mentioned are not excluded.

The term "air equivalence ratio" (AR) means the ratio of the amount of air supplied to the combustion reactor divided by the amount of air required for complete fuel combustion. Air equivalence ratio, "AR," can be represented by the following equation:

AR=(Air supplied to the combustion reactor)/(Air required for complete fuel combustion)

The term "British Thermal Unit" (BTU) means the amount of heat energy needed to raise the temperature of one pound of water by one degree Fahrenheit. One thousand BTU is denoted as MBTU, and one million BTU is denoted as MMBTU.

The term "carbon content" means all carbon contained in the fixed carbon (see definition below) as well as in all the volatile matter in a fuel.

The term "carbon conversion" means to convert solid carbon in a fuel feed into carbon-containing gases, such as CO, $CO_2$.

The term "cofiring ratio", in the context of a multi-fuel processing system or subsystem, means a ratio of the sum of input parameters of one or more fuels (but less than all the fuels) to the sum of the input parameters of all the fuels in the multi-fuel processing system, such as, but not limited to, a cogasification system, or a cofiring combustion system. The term "input parameter" of a fuel in this context may refer to the weight of the fuel, the weight per unit time of the fuel, the heat value (also termed "heat basis" or "energy basis") of the fuel, or the heat value per unit time of the fuel. For example, in a multi-fuel system processing four different fuels in quantities of F1, F2, F3, F4, a cofiring ratio for fuel F1 is given by:

$$(\text{Cofiring Ratio})_{F1}=(F1)/(F1+F2+F3+F4)$$

While a cofiring ratio for the combination of fuels F1, F2 (e.g. where F1, F2 might be the same or different varieties of engineered fuel, and F3, F4 might be the same or different varieties of coal) is given by:

$$(\text{Cofiring Ratio})_{F1+F2}=(F1+F2)/(F1+F2+F3+F4)$$

The term "commercial waste" means solid waste generated by stores, offices, restaurants, warehouses, and other non-manufacturing, non-processing activities. Commercial waste does not include household, process, industrial or special wastes.

The term "engineered fuel" is any fuel that is partially or wholly sourced from residential and/or commercial waste (MSW), and may contain one or more chemical additives. In some embodiments of the inventions "engineered fuel" is produced to have particular chemical and physical characteristics.

The term "fossil fuel" is any fuel originally formed by the decomposition of dead organisms. Non-limiting examples of fossil fuels are coal, petroleum, and natural gas, and variants thereof.

The term "garbage" means putrescible solid waste including animal and vegetable waste resulting from the handling, storage, sale, preparation, cooking or serving of foods. Garbage originates primarily in home kitchens, stores, markets, restaurants and other places where food is stored, prepared or served.

The term "hazardous waste" means solid waste that exhibits one of the four characteristics of a hazardous waste (reactivity, corrosivity, ignitability, and/or toxicity) or is specifically designated as such by the EPA as specified in 40 CFR part 262.

The term "Heating Value" is defined as the amount of energy released when a fuel is burned completely. The heating value can be expressed as "Higher Heating Value, HHV" or "Gross Caloric Value, GCV" when the water produced during combustion is in a liquid state at a reference temperature, or "Lower Heating Value, LHV" or "Net Caloric Value, NCV", when the water produced is in vapor form at the reference temperature.

The term "higher heating value" (HHV) means the caloric value released with complete fuel combustion with the product water in liquid state. On a moisture free basis, the HHV of any fuel can be calculated using the following equation:

$$HHV\text{Fuel}=146.58C+568.78H+29.4S-6.58A\ 51.53(O+N).$$

wherein C, H, S, A, O and N are carbon content, hydrogen content, sulfur content, ash content, oxygen content and nitrogen content, respectively, all in weight percentage.

The term "municipal solid waste" (MSW) means solid waste generated at residences, commercial, or industrial establishments and institutions, and includes all processable wastes along with all components of construction and demolition debris that are processable, but excluding hazardous waste, automobile scrap and other motor vehicle waste, infectious waste, asbestos waste, contaminated soil and other absorbent media and ash other than ash from household stoves. Used tires are excluded from the definition of MSW. Components of municipal solid waste include without limitation plastics, fibers, paper, yard waste, rubber, leather, wood, and also recycling residue, a residual component containing the non-recoverable portion of recyclable materials remaining after municipal solid waste has been processed with a plurality of components being sorted from the municipal solid waste.

The term "nonprocessable waste" (also known as noncombustible waste) means waste that does not readily combust. Nonprocessable wastes include but are not limited to: batteries, such as dry cell batteries, mercury batteries and vehicle batteries, refrigerators, stoves, freezers, washers, dryers, bedsprings, vehicle frame parts, crankcases, transmissions, engines, lawn mowers, snow blowers, bicycles, file cabinets, air conditioners, hot water heaters; water storage tanks, water softeners, furnaces, oil storage tanks, metal furniture, propane tanks, and yard waste.

The term "processed MSW waste stream" means that MSW has been processed at, for example, a material recovery facility (MRF), by having been sorted according to types of MSW components. Types of MSW components include, but are not limited to, plastics, fibers, paper, yard waste, rubber, leather, wood, and also recycling residue, a residual component containing the non-recoverable portion of recyclable materials remaining after municipal solid waste has been processed with a plurality of components being sorted from the municipal solid waste. Processed MSW contains substantially no glass, metals, grit, or non-combustibles. Grit includes dirt, dust, granular wastes such as sand, and as such the processed MSW contains substantially no sand.

The term "processable waste" means wastes that readily combust. Processable waste includes, but is not limited to, newspaper, junk mail, corrugated cardboard, office paper, magazines, books, paperboard, other paper, rubber, textiles, and leather from residential, commercial, and institutional sources only, wood, food wastes, and other combustible portions of the MSW stream.

The term "recycling residue" means the residue remaining after a recycling facility has processed its recyclables from incoming waste which no longer contains economic value from a recycling point of view.

The term "sludge" means any solid, semisolid, or liquid generated from a municipal, commercial, or industrial wastewater treatment plant or process, water supply treatment plant, air pollution control facility or any other such waste having similar characteristics and effects.

The term "solid waste" means unwanted or discarded solid material with-sufficient liquid content to be free flowing, including, but not limited to rubbish, garbage, scrap materials, junk, refuse, inert fill material, and landscape refuse, but does not include hazardous waste, biomedical waste, septic tank sludge, or agricultural wastes, but does not include animal manure and absorbent bedding used for soil enrichment or solid or dissolved materials in industrial discharges. The fact that a solid waste, or constituent of the waste, may have value, be beneficially used, have other use, or be sold or exchanged, does not exclude it from this definition.

The term "sorbent" means a material added to the engineered fuel that either acts as a traditional sorbent and adsorbs a chemical or elemental by-product, or reacts with a chemical or elemental by-product, or in other cases, simply as an additive to alter the engineered fuel characteristics such as ash fusion temperature and combustion effectiveness.

The term "volatile matter" means a fraction of fuel that can be liberated as combustible and/or non combustible gases or liquids from solid fuel when heated at a lower temperature.

The term "volatile organic matter" or VOC means organic chemical compounds that have high enough vapor pressures under normal conditions to significantly vaporize and enter the atmosphere. Non-limiting examples of volatile materials include alkanes, alkenes, aldehydes, ketones, aromatics such as benzene, and other light hydrocarbons.

The term "about" when immediately preceding a numerical value means a range of plus or minus 10% of that value, e.g., "about 50" means 45 to 55, "about 25,000" means 22,500 to 27,500, etc. Furthermore, the phrases "less than about" a value or "greater than about" a value should be understood in view of the definition of the term "about" provided herein.

The term "NOx" means oxides of nitrogen or nitrogen oxides, such as NO, $NO_2$, etc.

The term "SOx" means oxides of sulfur or sulfur oxides, such as SO, $SO_2$, $SO_3$, etc.

The term "oxidant" refers to an oxidizing agent or reactant including but limited to air, oxygen, or oxygen-enriched air.

Combustion System

A combustion system 100 according to a particular embodiment of the invention is schematically illustrated in FIG. 1. The system 100 is configured for cofiring engineered fuel with fossil fuels in commercial, industrial, and/or utility power plants. In some embodiments, the system 100 is used for cogasifying and cofiring coal with reengineered fuel derived from MSW. The system 100 includes first and second fossil fuel sources 102*a, b*, first and second engineered fuel sources 106*a, b*, first and second fuel treatment units 108*a, b*, and a combustor 111. It is noted that reference characters 102*a-b* and 106*a-b* may represent the fuel itself, and/or a corresponding fuel source.

Fossil fuel sources 102*a, b* are configured to provide fossil fuels to treatment units 108*a, b* respectively. Sources 102*a, b* may be the same source, and may provide fossil fuel that is identical or different in content, composition, form, and/or weight. In some embodiments, one of sources 102*a, b* may be optional. In some embodiments, the fossil fuel is coal or a coal blend that is suitable for combustion in a coal-fired power plant, and may include anthracite, lignite, bituminous coal, and combinations thereof. The sources 102*a*,b may also encompass upstream equipment necessary for generating the coal. Foe example, sources 102*a, b* may include one or more of excavation, transportation, storage, and processing equipment such as coal mills, crushers, pulverizers, and combinations thereof, as is known in the art. Each fossil fuel source 102*a, b* is coupled to its respective treatment unit 110*a, b* in any suitable manner for delivery of the fossil fuel.

Engineered fuel sources 104*a, b* are configured to provide engineered fuels to treatment 108*a, b* respectively. In some embodiments, the engineered fuel comprises MSW, and the sources 104*a, b* may encompass upstream equipment necessary for engineered fuel generation (e.g. producing densified pellets of engineered fuel) and/or processing (e.g. pulverizing the densified engineered fuel pellets). For example, sources 104*a, b* may include one or more of processes such as material classification and separation, shredding, granulation, densification and pulverization. In some embodiments, at least one of the engineered fuels 104*a, b* comprise MSW and one or more sorbents. In some embodiments, the sorbent in each engineered fuel is independently selected from the group consisting of sodium sesquicarbonate (Trona), sodium bicarbonate, sodium carbonate, zinc ferrite, zinc copper ferrite, zinc titanate, copper ferrite aluminate, copper aluminate, copper managanese oxide, nickel supported on alumina, zinc oxide, iron oxide, copper, copper (I) oxide, copper (II) oxide, limestone, lime, Fe, FeO, $Fe_2O_3$, $Fe_3O_4$, iron filings, $CaCO_3$, $Ca(OH)_2$, $CaCO_3 \cdot MgO$, $CaMg_2(CH_3COO)_6$, silica, alumina, china clay, kaolinite, bauxite, emathlite, attapulgite, coal ash, egg shells, Ca-montmorillonite and organic salts (such as calcium magnesium acetate (CMA), calcium acetate (CA), calcium formate (CF), calcium benzoate (CB), calcium propionate (CP) and magnesium acetate (MA). In some embodiments, the sorbent-containing engineered fuel is cogasified or cofired at a temperature that exceeds the sintering temperature of at least one of the sorbents included therein, and combining the sorbent(s) with the engineered fuel prevents sintering of the sorbent(s) under such conditions.

In some embodiments, the engineered fuels 104*a, b*, when combusted and/or cofired with coal, produce less of one or more pollutants or undesirable combustion by-products. Thus, in some embodiments, the engineered fuels 104*a, b* produce fewer sulfur emissions as compared to the produce fewer heavy metal emissions as compared the known level of heavy metal emissions of coal when combusted. In some embodiments, the engineered fuels 104*a, b* produce fewer emissions of particulate matter (PM) as compared to known levels of particulate matter emitted by coal when combusted.

In some embodiments, the engineered fuels 104*a, b* produce fewer emissions of NOx, as compared to known levels of NOx emitted by coal when combusted. In some embodiments, the engineered fuels 104*a, b* produce fewer emissions of CO, as compared to known levels of CO emitted by coal when combusted. In some embodiments, the engineered fuels 104*a, b* produce fewer emissions of $CO_2$, as compared to known levels of $CO_2$ emitted by coal when combusted. In some embodiments, the engineered fuels 104*a, b* produce fewer emissions of volatile organic compounds (VOCs), as compared to known levels of VOCs emitted by coal when combusted. In some embodiments, the engineered fuels 104*a, b* produce fewer emissions of halogen gases as compared to known levels of halogen gases emitted by coal when combusted. In some embodiments, the engineered fuels 104*a, b* produce fewer greenhouse gas (GHG) emissions as compared to the known level of GHG emitted by coal when combusted.

Each engineered fuel source 104*a, b* is coupled to its respective treatment unit 108*a, b* in any suitable manner for delivery of the engineered fuel. Engineered fuel sources 104*a, b* may be the same source, and may provide engineered fuel that is identical or different in content, composition, form, and/or weight. In some embodiments, one of engineered fuel sources 104*a, b* is optional. In some embodiments, engineered fuel from sources 104*a, b* differ at least in the sorbent content, composition, form, and/or weight, such that the first engineered fuel 104*a* is optimized for burning in a reducing environment, while the second engineered fuel 104*b* is optimized for burning in an overall oxidizing environment (i.e. a reducing environment or zone may exist locally or regionally within the oxidizing environment). In the illustrated embodiment of FIG. 1, the treatment unit 108*a* is configured to receive the first fossil fuel 102*a* and the first engineered fuel 104*a*, and the treatment unit 108*b* is configured to receive the second fossil fuel 102*b* and the second engineered fuel 104*b* in any suitable manner. Each treatment unit 108*a, b* is operable for treatment of the first fossil fuel 102*a* and the first engineered fuel 104*a*, and may independently include the apparatus and functionality of one or more of, but not be limited to, milling equipment, co-milling equipment, blending equipment, air pump equipment, cofiring equipment (e.g. gasifiers, combustors, and boilers), and subsystems, combinations thereof. Suitable combustion equipment includes fixed bed combustors, fluidized bed combustors, and pulverized fuel combustors. Suitable gasification equipment includes fixed bed gasifiers such as updraft (counter-current) gasifiers and downdraft (co-current) gasifiers, entrained flow gasifiers, fluidized bed gasifiers, internally or externally circulating fluidized bed gasifiers, and other types of gasifiers such as auger driven gasifiers. In some embodiments, at least one treatment unit 108 *a, b* comprises a cofiring unit. In some embodiments, the cofiring unit is selected from: a gasifier, a combustor, and a boiler. In some embodiments, the cofiring unit is a combustor or a boiler, the combustor or boiler comprising a bed zone operated in a reducing environment. In some embodiments, the cofiring unit may be a gasifier having a reducing environment. In some embodiments, the cofiring unit may be a combustor or a boiler that may have an overall oxidizing environment, and comprises a reducing zone, such as a fluidized bed combustor or a stoke boiler, having a bed zone that provides a reducing environment. Each treatment unit 108*a, b* is independently coupled to the combustor 112 in any suitable manner, depending on the operations and the output of the treatment unit (discussed later). It is understood that additional treatment units, fossil fuel sources, and engineered fuel sources (not shown) are within the scope of the invention, and may be interconnected in any suitable manner, depending on the configuration and operation of the combustor 112.

In some embodiments, the first treatment unit 108*a* receives the first fossil fuel 102*a* and the first engineered fuel 104*a* at a first cofiring ratio of the first engineered fuel, and processes substantially the entirety of the received fuels 102*a*, 104*a* is processed. In some embodiments, the first treatment unit 108*a* receives fuels 102*a*, 104*a* at a ratio different than the first cofiring ratio, and is operable to manipulate the received fuels 102*a*, 104*a* so as to achieve the first cofiring ratio prior to treatment. Such manipulation may include, but is not limited to, temporary storage of the fuel, mixing/blending, and heating In some embodiments, the fuel sources 102*a*, 104*a*, and the first treatment unit 108*a* cooperate to maintain operation of the first treatment unit 108*a* at the first cofiring ratio.

In a similar manner, the second treatment unit 108*b* may be operable for treatment of the entirety of the received fuels 102*b*, 104*b* at a second cofiring ratio of the second engineered fuel, and/or for manipulation of the received fuels to achieve the second cofiring ratio prior to treatment. In some embodiments, the fuel sources 102*b*, 104*b*, and the second treatment unit 108*b* cooperate to maintain operation of the second treatment unit 108*b* at the second cofiring ratio.

An overall cofiring ratio of the engineered fuel for the combustion system 100 can be calculated based on the total engineered fuel 104*a, b* and the total fossil fuel 102*a, b* treated the treatment units 108*a, b* at the first and second cofiring ratios, respectively. In other words, the overall cofiring ratio is indicative of the relative amounts of fossil fuel and engineered fuel fed to combustion system 100 that are ultimately utilized by the combustion system to generate power. In some embodiments, the overall cofiring ratio is varied while maintained fixed values of the first cofiring ratio and the second cofiring ratio. In some embodiments, the overall cofiring ratio is varied, by varying an input characteristic of at least two of the first engineered fuel 104*a*, the first fossil fuel 102*a*, the second engineered fuel 104*b*, and the second fossil fuel 102*b*, such that the first cofiring ratio and the second cofiring ratio are substantially unchanged. In some embodiments, the varied input characteristic of the fuel is one or more of the weight of the fuel (e.g. in metric tons), the rate of supply of the fuel (e.g. in tons per year), and the heat value of the fuel (e.g. in millions of British Thermal Unit, or MMBtu). In some embodiments, two or more of the fossil fuel sources 102*a-b*, the engineered fuel sources 104*a-b*, and the treatment units 108*a-b* cooperate to vary the cofiring ratio such that the first cofiring ratio and the second cofiring ratio are substantially unchanged.

In some embodiments, the first and second cofiring ratios of engineered fuel are independently about 0%, about 5%, about 6%, about 7%, about 8%, about 9%, about 10%, about 11%, about 12%, about 13%, about 14%, about 15%, about 16%, about 17%, about 18%, about 19%, about 20%, about 25%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 58%, about 60%, about 61%, about 62%, about 63%, about 64%, about 65%, about 66%, about 67%, about 68%, about 69%, about 70%, about 75%, about 80%, about 85%, about 90%, about 95%, or about 100%. In some embodiments, the combustion system 100 is operable to attain an overall cofiring ratio of engineered fuel of about 0%, about 5%, about 10%, about 15%, about 20%, about 21%, about 22%, about 23%, about 24%, about 25%, about 26%, about 27%, about 28%, about 29%, about 30%, about 35%, about 40%, about 45%, about 50%, about 55%, about 60%, about 65%, about 70%, about 75%, about 80%, about 85%, about 90%, about 95%, or about 100%, and all ranges and subranges therebetween. Unless specified otherwise, cofiring ratio refers to a ratio of engineered fuel(s) to total fuel (i.e. engineered fuel(s) and fossil fuel(s)).

Figure 2A:
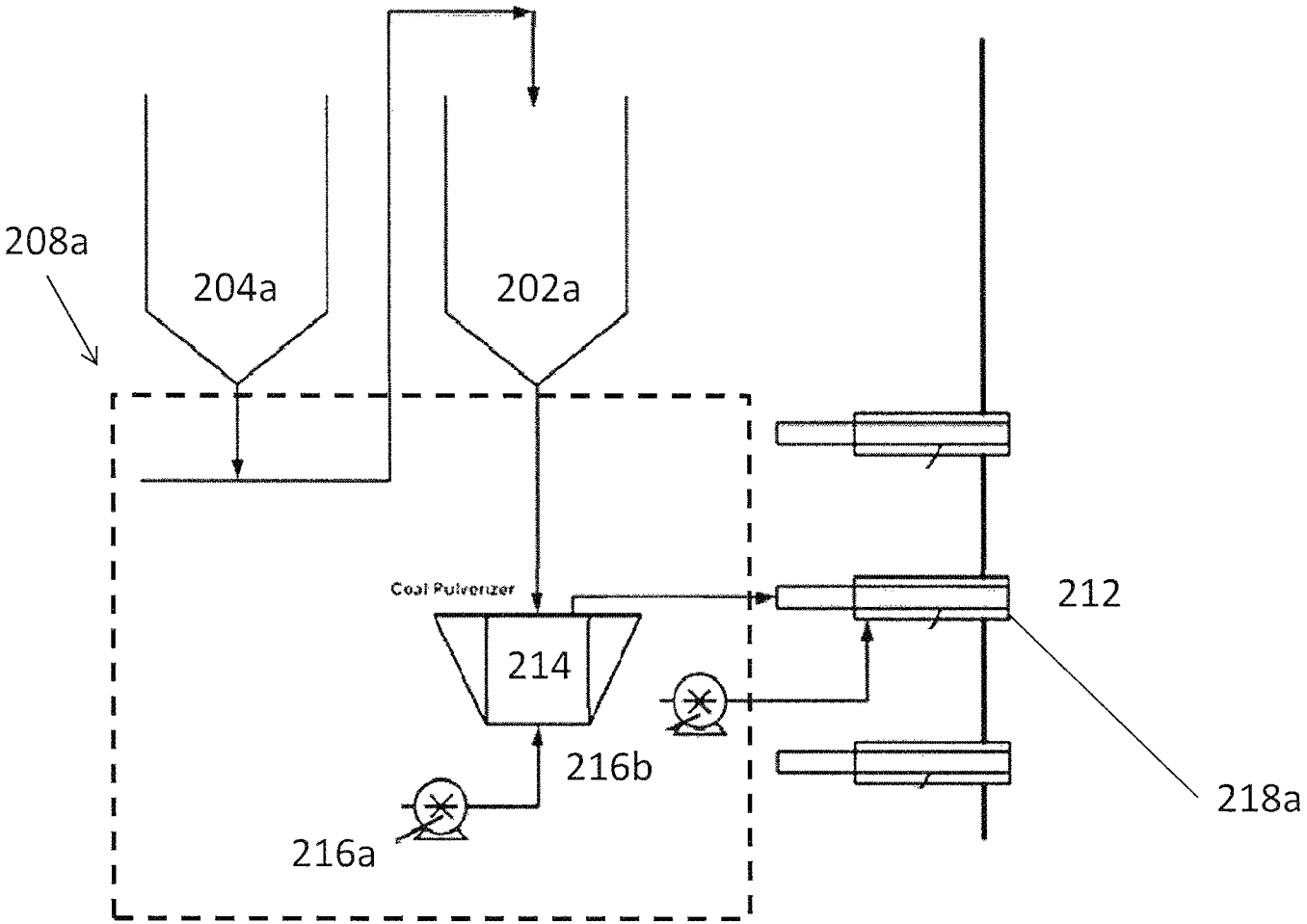
FIG. 2A is a schematic of an exemplary cofiring system employed by the system of FIG. 1.

In some embodiments, the first treatment unit 108*a* is operable in a cofiring mode, where the treatment unit separately mills the first fossil fuel 102*a* and the first engineered fuel 104*a*, followed be separate delivery of each fuel to a different port of the combustor 112, via a suitable conduit for example. FIG. 2A illustrates a non-limiting example of a cofiring approach where the first treatment unit 208*a* comprises a coal pulverizer 214 that delivers a combined stream of engineered fuel 204*a* and coal 202*a* to an input port or nozzle 218*a* of combustor 212. The first treatment unit 208*a* also includes compressors 216*a, b* for providing carrier gas for transporting the combined fuel stream to the combustor 212. In some embodiments, such as in a commercial boiler configuration, the compressors 216*a, b* may be a single, common indirect draft fan (ID fan) with flow dividers to split the carrier gas to different fuel delivery lines, and into primary and secondary air flows of the combustor 212, such as the nozzle 218*a* for example.

Figure 2B:
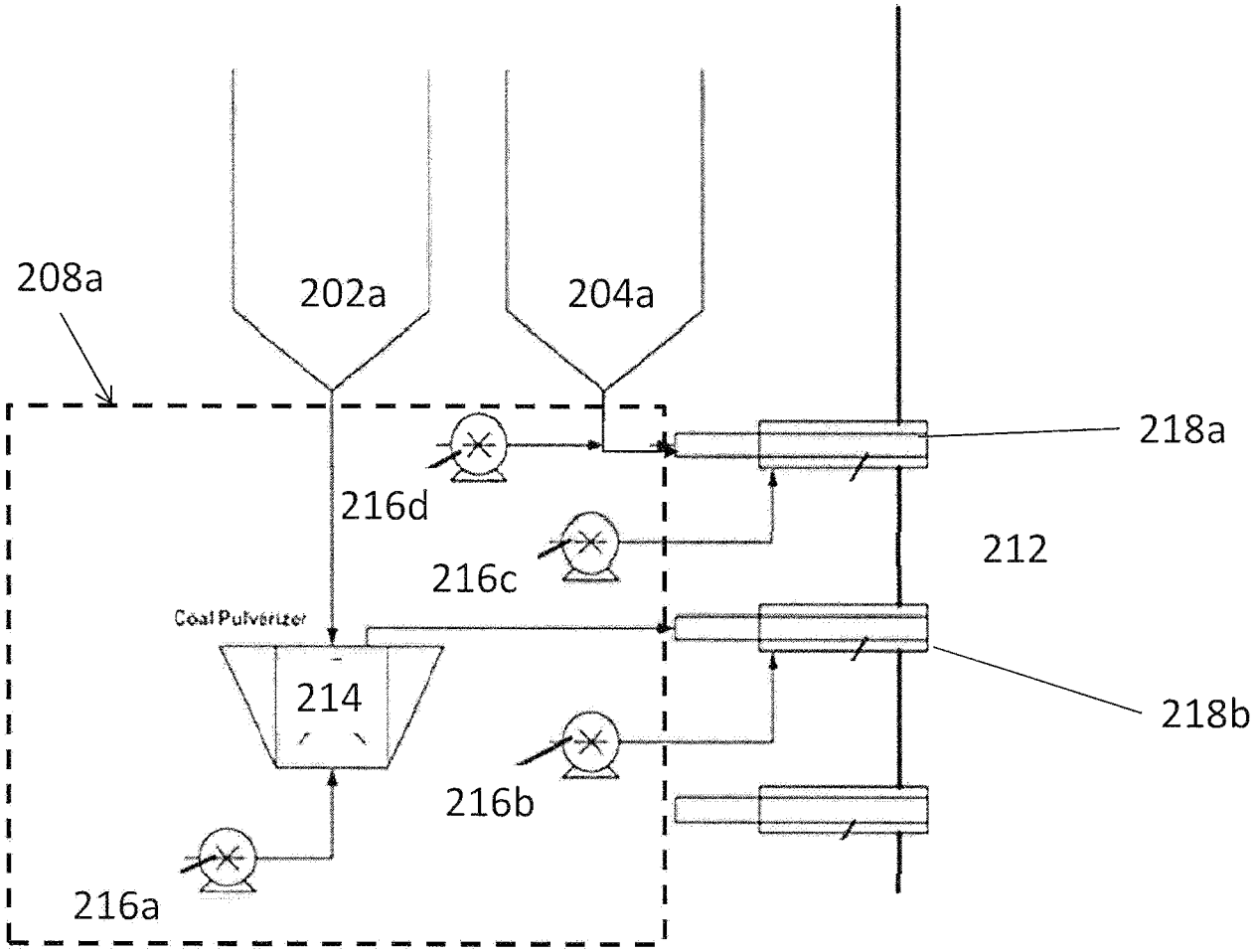
FIG. 2B is a schematic of an exemplary cofiring system employed by the system of FIG. 1.

In some embodiments, the first treatment unit 108*a* is operable in a cofiring mode where the treatment unit co-mills the first fossil fuel 102*a* and the first engineered fuel 104*a* for combined delivery to the combustor 112. FIG. 2B illustrates a non-limiting example of a cofiring approach where the first treatment unit 208*a* comprises a coal pulverizer 214 that delivers the coal 202*a* to the nozzle 218*b* of combustor 212, and also delivers engineered fuel 204*a* without substantial processing to the nozzle 218*a*. The first treatment unit 208*a* also includes compressors 216*a-d* that provide carrier gas for transporting the fuels 202*a*, 204*a* to the combustor 212. As discussed above for FIG. 2A, in some embodiments, the compressors 216*a-d* may be a single common ID fan with flow dividers to split the carrier gas to different fuel delivery lines and into nozzles 218*a, b*.

Figure 2C:
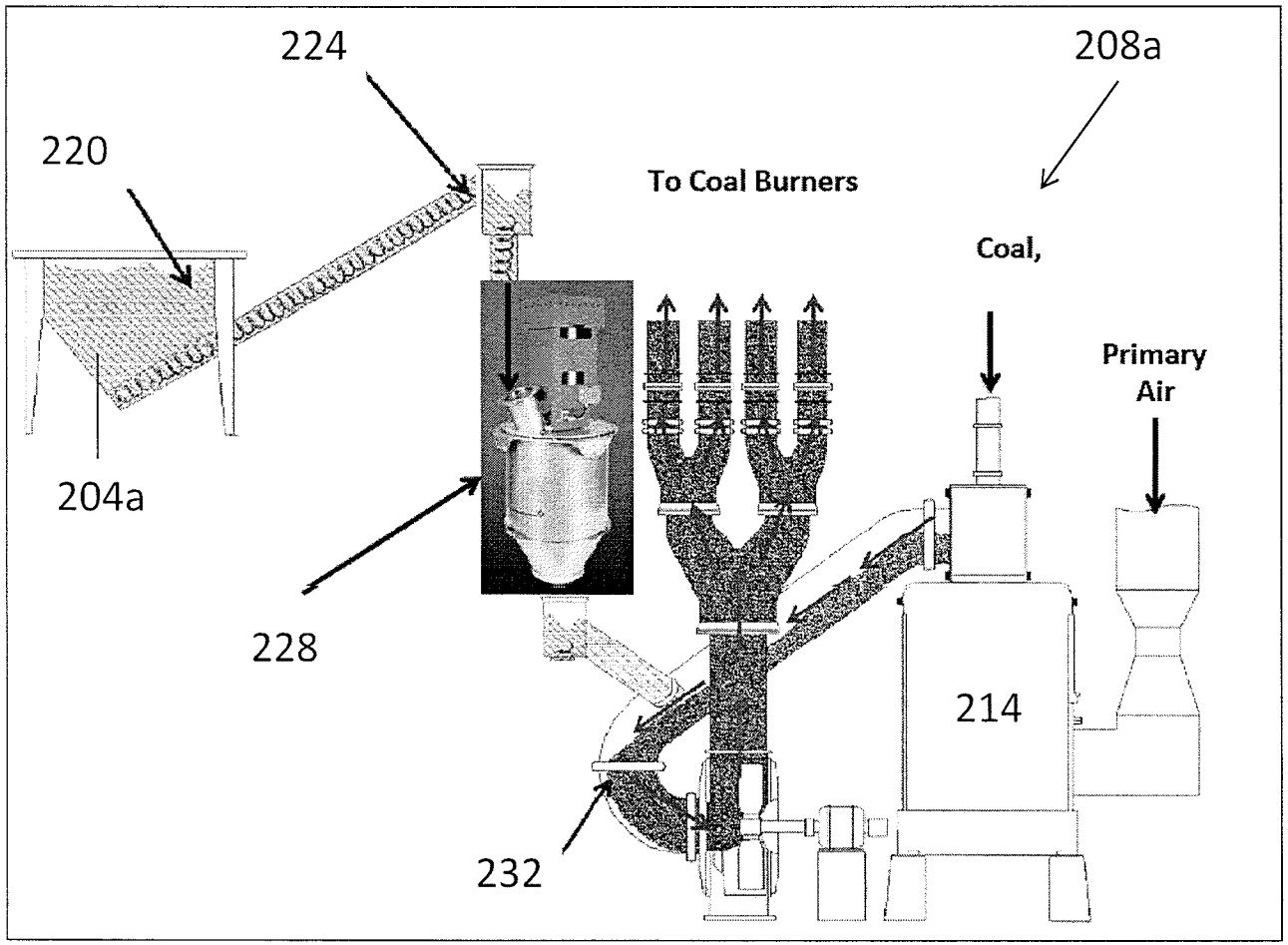
FIG. 2C is a schematic of an exemplary cofiring system for a commercial scale pulverized coal boiler.

FIG. 2C illustrates another non-limiting embodiment of a fuel feeding system of the first treatment unit 208*a*, applicable to either embodiment illustrated in FIGS. 2A-B. The engineered fuel 204*a* is delivered to in a granulated or pulverized form to the treatment unit 208*a*, and stored in a fuel banker 220 of the first treatment unit. A conveyor 224 transports the engineered fuel 204*a* to a mass flow meter 228 before it is fed to the gooseneck section 232 of the coal pulverizer 214 by air suction. In some embodiments, the coal pulverizer 214 operates with only air flow (no coal), and in other embodiments the coal pulverizer receives a minimum coal feed (e.g. 20% of mill's capacity).

In some embodiments, the engineered fuel can be delivered in densified form, and fed to the coal feed pipe. In still other embodiments, the granulated or pulverized engineered fuel can be fed to the mill's exhauster side. In some embodiments the above engineered fuel feeding applies to one of the existing coal mills, and in other embodiments the engineered fuel feeding is implemented to every mill; each mill may have the same or different cofiring ratios.

In some embodiments, the first treatment unit 108*a* is operable for cogasification of the first fuel 102*a* and the first engineered fuel 104*b* to generate syngas for delivery to the combustor 112. While described with respect to the first treatment unit 108*a*, it is understood that some or all of these operations may be additionally or alternatively performed by the second treatment unit 108*b*. In some embodiments, the first treatment unit 108*a* separately mills or co-mills the first fossil fuel 102*a* and the first engineered fuel 104*a* for separate delivery to the combustor 112, while the second treatment unit 108*b* comprises a gasifier that cogasifies the second fossil fuel 102*b* and the second engineered fuel 104*b* to produce syngas for delivery to the combustor 112.

The combustor or combustion reactor 112 is operable for combustion of one or more fuels received from treatment units 108*a, b*, although other sources of fuel and various combustion components such as air, dry sorbent, etc. are within the scope of the invention. The combustor 112 may be designed in any suitable manner known in the art, including as a fixed bed combustor, a bubbling, turbulent or circulating fluidized bed combustor, and a pulverized fuel combustor. The combustor 112 may comprises a primary combustion zone, an overfire zone, a reburn zone, and a convection zone. In some embodiments, the combustor 112 is a furnace and the generated heat is passed to a separate generator (not shown) for heat recovery and steam generation. In some embodiments, the combustor 112 is a boiler and generates steam for powering a steam turbine, thereby generating electricity.

In some embodiments, the combustor 112 receives fossil fuel and engineered fuel from one or more of the treatment units 108*a, b*, and is operable for cofiring the received fuels in the primary combustion zone. In some embodiments, the combustor 112 receives fossil fuel, engineered fuel and syngas from one or more of the treatment units 108*a, b*, and is operable for cofiring the received fuels in the primary combustion zone, and is further operable for burning the received syngas in the reburn zone.

In some embodiments, the combustor 112 receives fossil fuel and engineered fuel from one or more of the treatment units 108*a, b*, and is operable for cofiring the received fuels in the primary combustion zone. In some embodiments, the combustor 112 receives fossil fuel, engineered fuel and syngas from one or more of the treatment units 108*a, b*, and is operable for cofiring the received fuels in the primary combustion zone, and is further operable for burning the received syngas in the reburn zone.

Embodiments of the present invention provide a cofiring process that has the ability to reduce the air emissions from cofiring of engineered fuels (e.g. derived from MSW) and fossil fuels such as coal, thereby eliminating or substantially reducing the need for conventional and expensive flue gas treatment technologies such as FGD and SCR.

Embodiments of the present invention provide a cofiring process of a combustion system 100 with an overall cofiring ratio that can vary in a wide range without, or with acceptable minimal, effect on the operation of individual system components. In other words, the present invention is operable to vary the overall cofiring ratio of a combustion system 100 in a wide range while the treatment units 108*a, b* are still able to operate at first and second cofiring ratios that are constant and optimal, regardless of the overall cofiring ratio. In some embodiments, the overall cofiring ratio of system 100 can be varied to meet regulatory and/or accounting standards (e.g. such as set by the EPA) that distinguish between $CO_2$ emissions from combustion of biogenic sources (e.g. such as engineered fuels derived from biomass) as compared to combustion of fossil fuels, which are non-biogenic.

Embodiments of the present invention provide a cofiring process that leverages and benefits the interaction between fuels of different origin and characteristics. According to embodiments of the invention, a small amount of engineered fuel, specially formulated and produced to be suitable for strong oxidizing combustion condition, is directly cofired with coal in an existing coal-fired boiler. The resulted cofiring ratio is low enough (e.g. <5-10%) to ensure safe and smooth cofiring operation, but sufficient to allow the engineered fuel to also act as emission reduction reagents carrier. In this manner, the engineered fuel accomplishes multiple functions, namely, renewable fuel value, coal combustion promoter due to high volatile content (which allows the coal-fired boiler to low its temperature without reducing carbon conversion while lowing NOx production), air emission and system corrosion control reagents or additives carrier. Since the cofiring ratio can be sufficiently low, the risks associated with variation in fuel quality and supply are efficiently mitigated.

According to embodiments of the present invention, a treatment unit that is a cofiring unit such as a gasifier, combustor or boiler is operated with a coal and engineered fuel mixture at a relatively high but optimally determined constant cofiring ratio (i.e. 50-70% of the engineered fuel). By cofiring or cogasifying the engineered fuel and coal in this cofiring unit, problems usually associated with biomass based engineered fuels are substantially mitigated. By their very nature, biomass ash may contain a larger amount of alkalines, especially NaCl and KCl, which are problematic because of their low melting temperature, formation of corrosive deposits, and reaction with iron to release element chloride ($Cl_2$). Coal ash has significantly different characteristics than biomass ash, typically containing high melt temperature and stable aluminum silicates. Coal ash can retain elements released from biomass ash to form thermally stable compounds, and hence mitigate the issues encountered when biomass is fired alone.

Embodiments of the invention provide a cofiring process in which an engineered fuel specially optimized for application in reducing environment (i.e. free of or lacking of oxygen) and another engineered fuel specially optimized for application in oxidizing environment are separately cofired with coal in a reducing environment (e.g. when one of treatment units 108*a, b* comprises a gasifier) and a oxidizing environment (e.g. the combustor 112). The two distinctly featured engineered fuels can have physical and/or chemical characteristics that best suit their particular targeted applications.

According to one aspect of the present invention, the engineered fuel specially optimized for a reducing environment, such as during gasification (e.g. the engineered fuel 104*b*), may have higher fuel nitrogen, in order to produce more ammonia, which is then used subsequently as NOx reducing agent in the combustor. This "reducing environment suitable engineered fuel" may also have a higher moisture in order to produce more methane, which would increase the syngas heating value to benefit the downstream combustion performance in combustor 112. The reducing environment suitable engineered fuel may contain different kinds and amounts of selected sorbents to achieve the best reactivity with emission compounds produced in the reducing environment (e.g. fuel sulfur to $H_2S$ rather than $SO_2$, and fuel nitrogen to $NH_3$ rather than NOx in oxidizing conditions). The reducing environment suitable engineered fuel may also contain additives to improve its ash characteristics such as fusion temperature, and additives to promote catalytic cracking of tars. Since gasification is generally operated at a lower temperature, especially when cogasified with engineered fuel, the selection of air emission control sorbent, sorbent efficiency and thermal stability can be greatly improved. In addition, gasification produces lower levels of flue gas than combustion, efficient ash removal can be achieved so PM emission is reduced.

According to embodiments of the invention, the engineered fuel specially optimized for combustion (e.g. engineered fuel 104*a*) may contain low fuel nitrogen, and/or lower moisture in order to reduce NOx generation, and increase combustion efficiency. In addition to reagents selected for $SO_2$, $SO_3$ and HCl emission reduction, the "oxidizing environment suitable engineered fuel" may also contain reagent to produce NOx reducing agent or promote NOx thermal reduction. In some embodiments, the same sorbents and additives are used for both the reducing and oxidizing environment suitable engineered fuels, and the respective amounts or contents of these sorbents or additives may be varied independently for each engineered fuel in order to make best and maximum utilization of these sorbents and additives.

In some embodiments, the present invention provides a cofiring process that attains the maximum possible energy conversion efficiency of the usually lower grade biomass based engineered fuels. Rather than simply combusting the low grade biomass or waste based fuels in a traditional combustor which has a typical electric generation efficiency around 20% by a steam turbine, some embodiments of the invention result in a power generation efficiency of about 30%, of about 31%, of about 32%, of about 33%, of about 34%, of about 35%, or close to about 40%, and all ranges and subranges therebetween. In some embodiments, the boiler is a supercritical boiler/steam generator, and achieves a power generation efficiency close to about 40%. According to some embodiments of the present invention, removal of chlorine and sulfur compounds during cogasification and cofiring substantially reduces the risk of fireside corrosion associated with (usually low grade and high chlorine content) biomass-containing engineered fuels, and thus allows the steam boiler to operate at same steam conditions as coal-fired boilers which have a typical heat rate of 10 MMBtu/MWh (or 34% efficiency).

Figure 3:
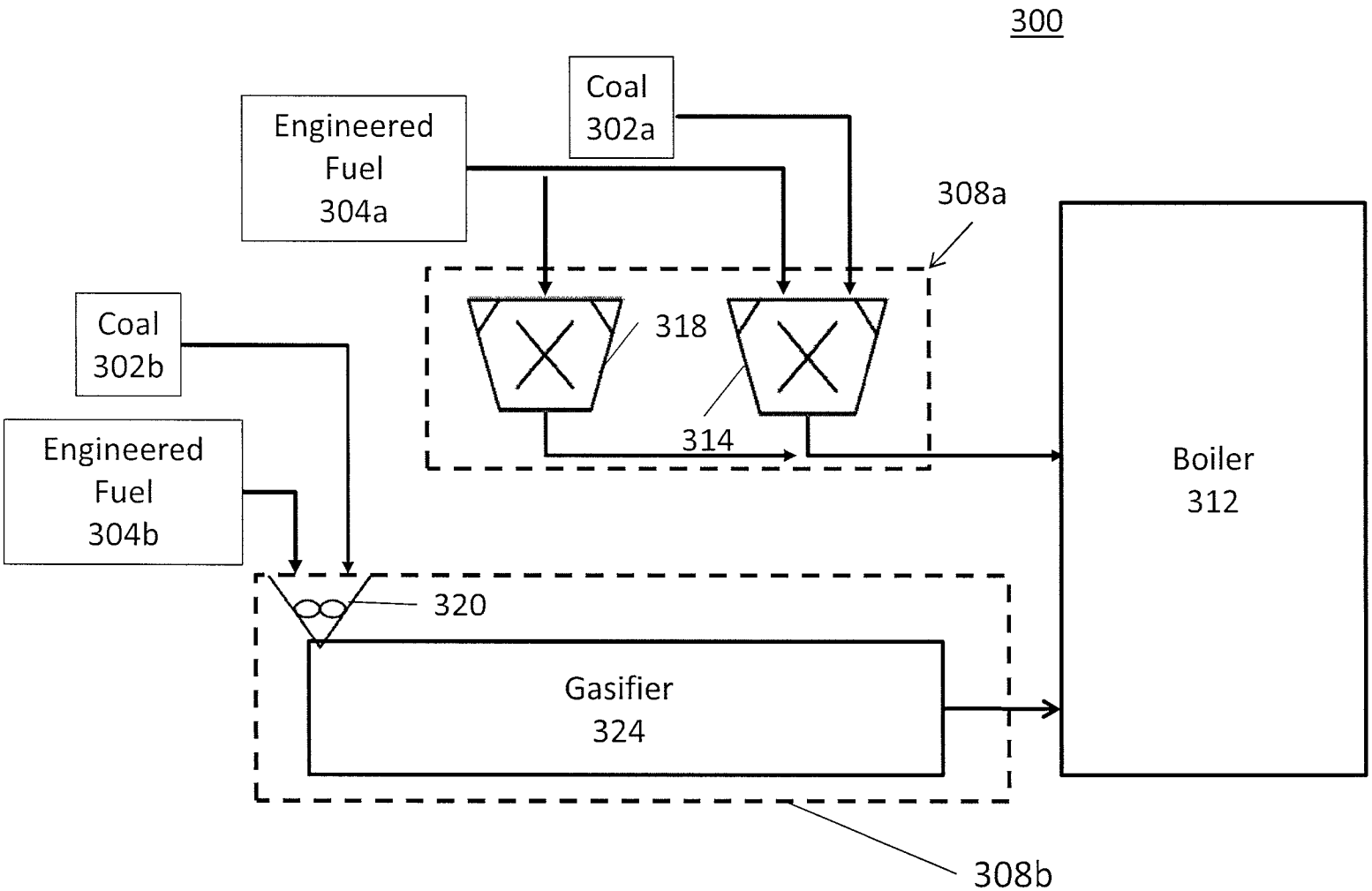
FIG. 3 is a schematic of an exemplary combustion system according to some embodiments of the invention.

FIG. 3 illustrates an exemplary embodiment of the present invention. The combustion system 300 comprises coal sources 302*a-b*, engineered fuel sources 304*a-b*, treatment units 308*a-b*, and a combustor (boiler) 312. Unless stated otherwise, it is understood that various components illustrated in FIG. 3 correspond substantially to similarly named and referenced components in FIG. 1. For example, coal sources 302*a-b* correspond to coal sources 102*a-b*, and so on.

Treatment unit 308*b* comprises a gasifier 324 that cogasifies a reducing environment suitable engineered fuel 304*b* with coal 302*a* at a second cofiring ratio, regardless of the overall cofiring ratio of system 300. The second cofiring ratio (also termed the cogasifying ratio in this case) may be lower than about 70%, be about 60%, be about 50%, be about 45%, be about 40%, be about 35%, or be about 30%. The gasifier 324 features reliable operation characteristics such as excellent material handling and processing ability. An exemplary gasifieris an auger driven, horizontally installed gasifier, such as one developed by ICM inc. of Wichita, Kans. The reducing environment suitable engineered fuel 304*b* may be either in loose or densified form, and is premixed with coal 302*b* by a blender 320 of treatment unit 308*b* prior to being fed into the gasifer 324. In some embodiments, the coal 302*b* and the reducing environment suitable engineered fuel 304*b* can be fed separately into the gasifier. After going through different steps of gasification as known in the art, including drying, de-volatilization, and char oxidation, a syngas comprising of primarily hydrogen and carbon monoxide is produced. In some embodiments, the reducing environment suitable engineered fuel 304*b* contains appropriate sorbents with amounts sufficient enough to react in-situ with sulfur and chlorine contained in both the cogasifying engineered fuel and coal 302*b*. In this manner, the product syngas is substantially free of $H_2S$ and HCl, so that problems associated with sulfur and chlorine, such as emission, corrosion and deposits can be substantially eliminated. The syngas, after dust removal if necessary (not shown), is sent to the boiler 312 where at least a portion of the syngas can be used as a NOx re-burning fuel. In addition to the syngas, the boiler 312 may be supplied with the engineered fuel 304*a* and the coal 302*a* at a predetermined first cofiring ratio by treatment unit 308*a*. The first cofiring ratio is less than about 5%, less than about 8%, less than about 10%, or less than about 15% in heat value. In this manner, the fuels 302*a*, 304*a* can be premixed and co-milled (e.g. by milling equipment 314 of treatment unit 308*a*) and burnt in the boiler 312. In some embodiments, the engineered fuel 304*a* can be separately milled (e.g. by milling equipment 318 of treatment unit 308*a*), and then mixed with the coal 302*a* to be burned in the boiler 312.

In some embodiment of the invention, as illustrated in FIG. 3, the combustor is configured to be a utility boiler 312. In some embodiments, the disclosed process can also be applied to other cofiring applications such as coal combustors in calcium calcinations and cement production kilns, steam generators for process (industrial boilers) or district heating or cooling.

Figure 4:
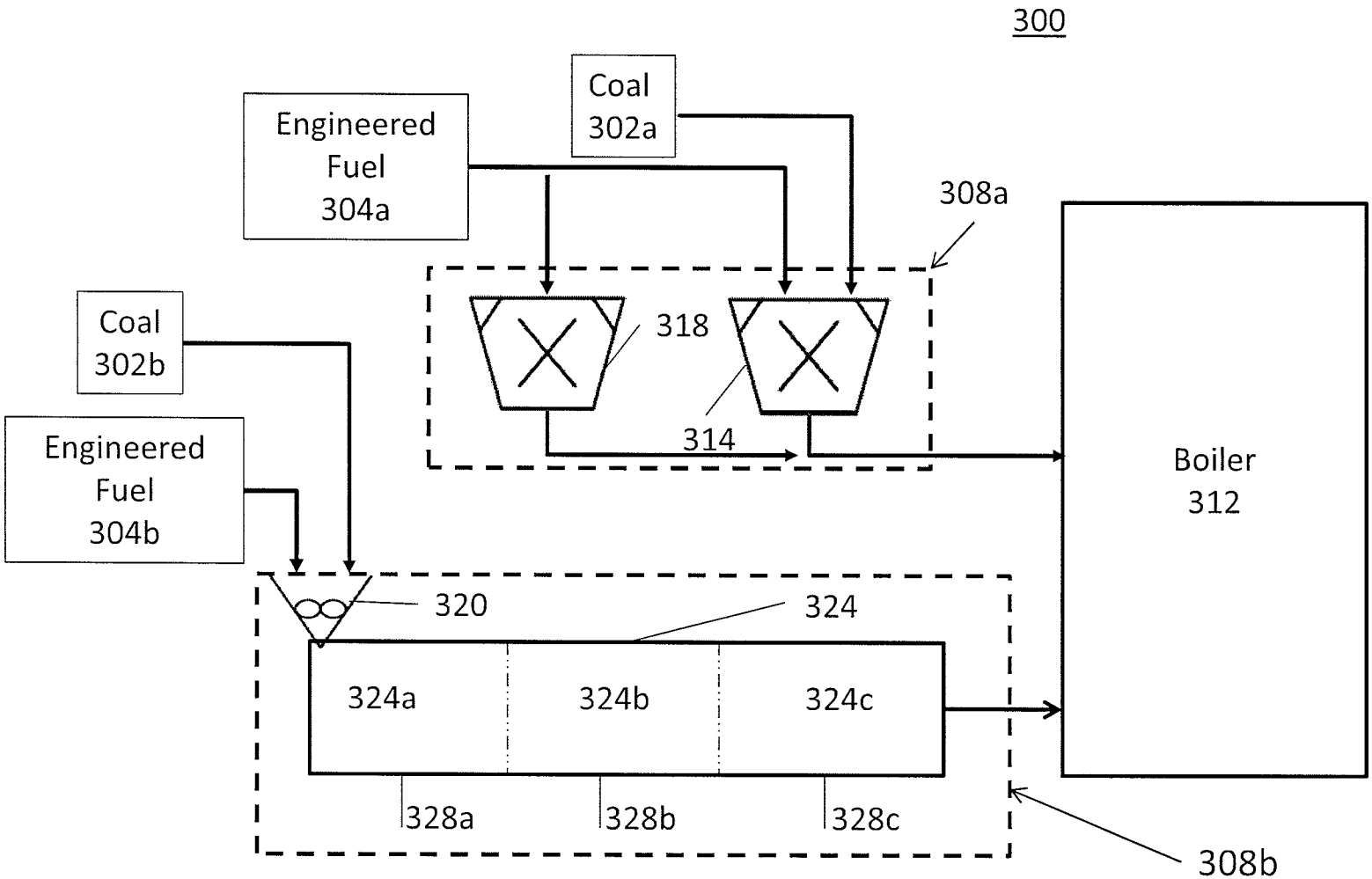
FIG. 4 is a schematic of the exemplary combustion system of FIG. 3 illustrating additional details of the gasifier.

In some embodiments, the gasifier 324 may be an air blown unit. In some embodiments, the gasifier may be operated with oxygen, and/or steam. In some embodiments, as best illustrated in FIG. 4, the gasifier 324 may be configured to comprise of a pyrolysis zone 324*a*, a gasification zone 324*b* and a combustion zone 324*c* successively. In these embodiments, air and/or steam can be supplied to different zones at different conditions of rates, temperatures, etc. (see oxidant streams 328*a*, 328*b*, and 328*c* in FIG. 4).

The following examples illustrate embodiments of the invention, and should not to be construed as limiting this disclosure in scope or spirit to the specific procedures herein described. It is to be understood that no limitation to the scope of the disclosure is intended thereby. It is to be further understood that resort may be had to various other embodiments, modifications, and equivalents thereof which may suggest themselves to those skilled in the art without departing from the spirit of the present disclosure and/or scope of the appended claims.

EXAMPLES

Reference Example 1

A computer process simulation is conducted using Aspen Plus V7.2 process simulation package. A coal having the characteristics listed in Table 1 (db: dry basis; ar: as received basis) is used. The engineered fuel can be formulated based on a typical waste residue composition in an advanced multi-material processing platform (MMPP) facility or traditional material recovery facility (MRF). The residue components are based on their weight composition with respect to paper, magazine, newsprint, cardboard, textile, plastics, woody biomass, yard trimmings and food scrap, etc. The engineered fuel is pelletized before chemical analysis. The analytical results are listed in Table 1 (column 'EF',). In all Examples below, the coal and EF feed rates are determined based on an assumed 400 MW power plant with an average heat rate of 9.478 MMBtu/MWh, with a total heat input rate of 7,582,400 MMBtu/hr. In all simulations, flue gas recycling technology is employed to control a constant flue gas temperature at 1,750° F. In case a gasifier is used, the air equivalence ratio is adjusted in order to maintain a constant syngas temperature at 1,400° F. Both gasification and combustion processes are simulated based on Gibbs free energy minimization method. All air emission pollutants (NOx, $SO_2$, $SO_3$, HCl, $Cl_2$) are provided in corresponding to 7% $O_2$ in flue gas.

TABLE 1

| Fuel characteristics | | |
|---|---|---|
| | Coal | EF |
| Moisture | 4.0 | 10 |
| Proximate Analysis | | |
| Fixed Carbon (db, wt. %) | 53.4 | 16.2 |
| Volatile (db, wt. %) | 36.4 | 75.1 |
| Ash (db, wt. %) | 10.2 | 8.7 |
| Ultimate Analysis | | |
| Carbon (db, wt. %) | 71.1 | 47.1 |
| Hydrogen (db, wt. %) | 5.2 | 6.3 |
| Nitrogen (db, wt. %) | 1.5 | 0.5 |
| Sulfur (db. wt. %) | 2.0 | 0.17 |
| Chlorine (db, wt. %) | 0.1 | 0.25 |
| Oxygen (db, wt. %) | 9.9 | 36.98 |
| Higher heating value (ar, Btu/lb) | 12,788 | 7,975 |

Example 1

This example establishes a baseline case in which 100% coal is combusted in a boiler. The coal feed rate is 296,475 lbs/hr. The simulation provided the following results (Table 2), with all concentration numbers corresponding to 7% $O_2$ in the flue gas. $Cl_2$ is given in ppb.

TABLE 2

| Pollutant | Concentration in Flue Gas, ppm | Emission Rate, lbs/MMBtu |
|---|---|---|
| NOx | 158 | 0.205 |
| $SO_2$ | 1,037 | 2.850 |
| $SO_3$ | 54 | 0.186 |
| HCl | 49 | 0.077 |
| $Cl_2$ | 1.2 | 3.51E−06 |

The simulation results demonstrate that:

NOx emission potential level is high, and therefore requires NOx emission control technologies to be installed in the practical applications $SO_2$ and HCl levels are significantly higher that the emission limits set up in the Clean Air Act[1]—(30 ppm for $SO_2$ and 25 ppm for HCl, all corrected to 7% $O_2$). Therefore, post combustion flue gas treatment, i.e. FGD, would be needed to meet such limits.

Standards of Performance for Large Municipal Waste Combustors for Which Construction is Commenced After Sep. 20, 1994 or for Which Modification or Reconstruction is Commenced After Jun. 19, 1996

The $SO_3$ is about 54 ppm in the flue gas exiting the boiler, which makes all issues likely to occur related to $SO_3$, i.e. downstream equipment corrosion and "blue plume" stack.

The estimated $Cl_2$ in flue gas is 1.2 ppb (part per billion), which might promote the production of dioxins and furans.

The results indicate that the baseline case would produce about 2,280,802 lbs/hr steam (at 955 F and 1,290 psia), or 3,310 MMbtu/hr, which corresponds to a thermal efficiency of 87.3% (under ideal adiabatic conditions).

Example 2

In this example, coal is directly cofired with 5% engineered fuel (in heat basis) in a premixed manner. The coal feed rate is 281,651 lbs/hr and the engineered fuel feed rate is 23,771 lbs/hr. The engineered fuel contains sulfur and chlorine abatement sorbents with amounts calculated based on total sulfur and chlorine from both coal and the engineered fuel. As a result, the $SO_2$, $SO_3$, HCl and $Cl_2$ concentrations in flue gas, or potential emission rates are reduced significantly compared to the above baseline case (Example 1), as shown in Table 3, with all concentration numbers corresponding to 7% $O_2$ in flue gas, and $Cl_2$ is given in ppb. With respect to NOx, there is only 2% reduction, likely because only 5% low fuel-nitrogen engineered fuel is cofired. Since $Cl_2$ is substantially free, dioxins/furans formation will also be greatly reduced by cofiring the engineered fuel with coal.

Directly cofired engineered fuel containing about 5% of sorbents can substantially reduce the air pollutants emissions, but the cofiring ratio is limited (i.e. <5% in heat basis). This greatly limits the use of renewably generated engineered fuel.

TABLE 3

| Pollutant | Concentration in Flue Gas, ppm | Emission Rate lbs/MMBtu | Reduction relative to Baseline Case, % |
|---|---|---|---|
| NOx | 155.5 | 0.201 | 1.9% |
| $SO_2$ | 0.4 | 0.001 | 100.0% |
| $SO_3$ | 0.0 | 0.000 | 100.0% |
| HCl | 0.1 | 0.000 | 99.9% |
| $Cl_2$ | 0.0 | 4.51E−12 | 100.0% |

Cofiring has no noticeable adverse effect on boiler efficiency. It is estimated that about 2,321,383 lbs/hr steam (at 955 F and 1,290 psia), or 3,369 MMbtu/hr of steam could be generated, which corresponds to a thermal efficiency of 88.9% (under ideal adiabatic conditions).

Example 3

In this example, coal is indirectly cofired with 30% engineered fuel (in heat basis). 207,533 lbs/hr of coal is supplied to the combustor with flue gas recycling to control the flue gas temperature at 1,750° F. The engineered fuel, at 142,624 lbs/hr, is supplied to a gasifier with the air equivalence ratio is controlled to maintain a syngas temperature of 1,400° F. The engineered fuel contains sulfur and chlorine abatement sorbents with amounts calculated based on sulfur and chlorine contained in the engineered fuel, and based on a predetermined stoichiometric ratio. The results are listed in Table 4, with all concentration numbers corresponding to 7% $O_2$ in flue gas, and $Cl_2$ is given in ppb.

The $SO_2$, $SO_3$, HCl and $Cl_2$ concentrations in flue gas, or potential emission rates are reduced by 29.7%, 26.6%, 42.3% and 74.1%, respectively, compared to the baseline case of Example 1. NOx is reduced by 14.2% because of a higher cofiring ratio.

TABLE 4

| Pollutant | Concentration in Flue Gas, ppm | Emission Rate lbs/MMBtu | Reduction relative to Baseline Case, % |
|---|---|---|---|
| NOx | 139.9 | 0.176 | 14.2% |
| $SO_2$ | 750.7 | 2.003 | 29.7% |
| $SO_3$ | 41.0 | 0.137 | 26.6% |
| HCl | 29.3 | 0.045 | 42.3% |
| $Cl_2$ | 0.3 | 9.07E−07 | 74.1% |

The simulation indicated that cofiring has no noticeable adverse effect on boiler efficiency. It is estimated that about 2,294,632 lbs/hr steam (at 955 F and 1,290 psia), or 3,331 MMbtu/hr of steam could be generated, which corresponds to a thermal efficiency of 87.8% (under ideal adiabatic condition).

Indirect cofiring with sorbent containing engineered fuel has the potential to reduce air emissions, but the benefits are limited because it may not be able to control the air emissions effectively from the main combustor.

Example 4

In this example, 173,324 lbs/coal and 14,628 lbs/hr oxidizing environment suitable engineered fuel (EF-O) (i.e. 5% engineered fuel in heat basis) is directly cofired in the main combustor, and 34,209 lbs/hr coal and 127,995 lbs/hr reducing environment suitable engineered fuel (EF-R) (i.e. 70% reengineered fuel in heat basis) is cogasified in a separate gasifier (see FIG. 4). This presents an overall cofiring ratio of about 30% (in heat basis).

The flue gas temperature of the combustor is controlled at 1,750° F. with flue gas recycling, and the gasifier temperature is controlled at 1,400° F. by controlling the air equivalence. The engineered fuel EF-O contains sulfur and chlorine abatement sorbents best suitable for oxidizing conditions with amounts calculated based on total sulfur and chlorine contained in the engineered fuel EF-O and cofired coal based on a predetermined stoichiometric ratio. The engineered fuel EF-R contains sulfur and chlorine abatement sorbents best suitable for reducing conditions with amounts calculated based on total sulfur and chlorine contained in the engineered fuel EF-R and cogasified coal based on another predetermined stoichiometric ratio. The simulation results are listed in Table 5, with all concentration numbers corresponding to 7% $O_2$ in flue gas, and $Cl_2$ is given in ppb.

As a result, the $SO_2$, $SO_3$, HCl and $Cl_2$ concentrations in flue gas, or potential emission rates are reduced by almost 100%, respectively, compared to the baseline case (Example 1). NOx reduction is about 10.5%.

TABLE 5

| Pollutant | Concentration in Flue Gas, ppm | Emission Rate lbs/MMBtu | Reduction relative to Baseline Case, % |
|---|---|---|---|
| NOx | 146.5 | 0.183 | 10.5% |
| $SO_2$ | 0.4 | 0.001 | 100.0% |

TABLE 5-continued

| Pollutant | Concentration in Flue Gas, ppm | Emission Rate lbs/MMBtu | Reduction relative to Baseline Case, % |
|---|---|---|---|
| $SO_3$ | 0.0 | 0.000 | 100.0% |
| HCl | 0.1 | 0.000 | 99.9% |
| $Cl_2$ | 0.0 | 4.25E−12 | 100.0% |

The results indicate that cofiring has no noticeable, adverse effect on boiler efficiency. It is estimated that about 2,291,724 lbs/hr steam (at 955 F and 1,290 psia), or 3,326 MMbtu/hr of steam could be generated, which corresponds to a thermal efficiency of 87.7% (under ideal adiabatic condition).

Example 5

In this example, 129,993 lbs/coal and 10,971 lbs/hr oxidizing environment suitable engineered fuel (EF-O) (i.e. 5% engineered fuel in heat basis) is directly cofired in the main combustor, and 47,892 lbs/hr coal and 179,194 lbs/hr engineered fuel (EF-R) (i.e. 70% engineered fuel in heat basis) is cogasified in a separate gasifier (see FIGS. 3-4). This presents an overall cofiring ratio of 40% (in heat basis) with the first cofiring ratio and the second cofiring ratio being substantially unchanged from Example 4.

The combustor temperature is controlled at 1,750° F. with flue gas recycling, and the gasifier temperature is controlled at 1,400° F. by controlling the air equivalence. The engineered fuel EF-O contains sulfur and chlorine abatement sorbents best suitable for oxidizing conditions with amounts calculated based on total sulfur and chlorine contained in the engineered fuel EF-O and cofired coal based on a predetermined stoichiometric ratio. The engineered fuel EF-R contains sulfur and chlorine abatement sorbents best suitable for reducing conditions with amounts calculated based on total sulfur and chlorine contained in the engineered fuel EF-R and cogasified coal based on another predetermined stoichiometric ratio. The simulation results are listed in Table 6, with all concentration numbers corresponding to 7% $O_2$ in flue gas, and $Cl_2$ is given in ppb.

As a result, the $SO_2$, $SO_3$, HCl and $Cl_2$ concentrations in flue gas, or potential emission rates are reduced by almost 100%, respectively, compared to the above baseline case (Example 1). The NOx reduction is increased to 14.4%.

TABLE 6

| Pollutant | Concentration in Flue Gas, ppm | Emission Rate lbs/MMBtu | Reduction relative to Baseline Case, % |
|---|---|---|---|
| NOx | 142.2 | 0.175 | 14.4% |
| $SO_2$ | 0.4 | 0.001 | 100.0% |
| $SO_3$ | 0.0 | 0.000 | 100.0% |
| HCl | 0.1 | 0.000 | 99.9% |
| $Cl_2$ | 0.0 | 4.18E−12 | 100.0% |

The simulation indicated that increasing the cofiring ratio there is a slight effect on boiler efficiency. It is estimated that about 2,279,976 lbs/hr steam (at 955 F and 1,290 psia), or 3,308 MMbtu/hr of steam could be generated, which corresponds to a thermal efficiency of 87.3% (under ideal adiabatic condition).

Example 6

In this example, 86,662 lbs/coal and 7,314 lbs/hr oxidizing environment suitable engineered fuel (EF-O) (i.e. 5% engineered fuel in heat basis) is directly cofired in the main combustor, and 61,576 lbs/hr coal and 230,392 lbs/hr reducing environment suitable engineered fuel (EF-R) (i.e. 70% engineered fuel in heat basis) is cogasified in a separate gasifier (see FIGS. 3-4). This presents an overall cofiring ratio of 50% (in heat basis), with the first cofiring ratio and the second cofiring ratio being substantially unchanges from Example 4.

The combustor temperature is controlled at 1,750° F. with flue gas recycling, and the gasifier temperature is controlled at 1,400° F. by controlling the air equivalence. The engineered fuel EF-O contains sulfur and chlorine abatement sorbents best suitable for oxidizing conditions with amounts calculated based on total sulfur and chlorine contained in the engineered fuel EF-O and cofired coal based on a predetermined stoichiometric ratio. The engineered fuel EF-R contains sulfur and chlorine abatement sorbents best suitable for reducing conditions with amounts calculated based on total sulfur and chlorine contained in the engineered fuel EF-R and cogasified coal based on another predetermined stoichiometric ratio. The simulation results are listed in Table 7, with all concentration numbers corresponding to 7% $O_2$ in flue gas, and $Cl_2$ is given in ppb.

As a result, the $SO_2$, $SO_3$, HCl and $Cl_2$ concentrations in flue gas, or potential emission rates are reduced by almost 100%, respectively, compared to the above baseline case (Example 1). The NOx reduction is increased to 17.8% because of high cofiring ratio.

TABLE 7

| Pollutant | Concentration in Flue Gas, ppm | Emission Rate lbs/MMBtu | Reduction relative to Baseline Case, % |
|---|---|---|---|
| NOx | 138.4 | 0.168 | 17.8% |
| $SO_2$ | 0.5 | 0.001 | 100.0% |
| $SO_3$ | 0.0 | 0.000 | 100.0% |
| HCl | 0.1 | 0.000 | 99.9% |
| $Cl_2$ | 0.0 | 4.05E−12 | 100.0% |

The simulation indicated that increasing the cofiring ratio there is a slight effect on boiler efficiency. It is estimated that about 2,267,645 lbs/hr steam (at 955 F and 1,290 psia), or 3,291 MMbtu/hr of steam could be generated, which corresponds to a thermal efficiency of 86.8% (under ideal adiabatic condition).

As indicated by these examples, embodiments of the present invention effectively control and reduce air emissions from both engineered fuel and coal, from both the main combustor and the secondary gasifier or combustor. Controlling and reducing emissions from both cofired fuels and from both reactors greatly reduces air emissions, equipment corrosion, and stack opacity (or blue plume) issue. It allows eliminating or minimizing the costs associated with conventional, expensive flue gas treatment technologies such as FGD and SCR, yielding significant environment and economic benefits.

To achieve these results, the main combustor or boiler is able to operate at a low, acceptable, and constant first cofiring ratio, and the secondary unit (gasifier or combustor) is also able to operate at a constant and acceptable second cofiring ratio, regardless of the overall cofiring ratio, which can be varied in a wide range without affecting operations of both the main combustor and the second gasifier or combustor. Embodiments of the present invention are advantageous for not limiting the overall cofiring ratio of the combustion system, while controlling and reducing emissions.

Those skilled in the art will recognize, or be able to ascertain, using no more than routine experimentation, numerous equivalents to the specific embodiments described specifically herein. Such equivalents are intended to be encompassed in the scope of the following claims.

We claim:

1. An integrated method for varying an overall cofiring ratio of a combustion system, comprising:

introducing a first engineered fuel and a first fossil fuel into a gasifier at a first cofiring ratio;

cogasifying the first engineered fuel and the first fossil fuel to produce syngas;

introducing a second engineered fuel and a second fossil fuel into a combustor at a second cofiring ratio;

introducing the produced syngas into the combustor;

cofiring the second engineered fuel, the second fossil fuel, and the produced syngas; and varying the overall cofiring ratio of combustion by varying an input characteristic of at least two of the first engineered fuel, the first fossil fuel, the second engineered fuel, and the second fossil fuel, wherein the first cofiring ratio and the second cofiring ratio are unchanged.

2. The method of claim 1, wherein the varied input characteristic is one of weight, weight per unit time, heat value, and heat value per unit time.

3. The method of claim 1, wherein the overall cofiring ratio is in a range from about 10% to about 50%.

4. The method of claim 1, wherein the second cofiring ratio is in a range from about 5 to about 20%.

5. The method of claim 1, wherein the first cofiring ratio is in a range from about 30% to about 70%.

6. The method of claim 1, wherein the fossil fuel comprises one or more variety of coal.

7. The method of claim 6, wherein the one or more variety of coal are selected from the group consisting of: anthracite, lignite, bituminous coal, and mixtures thereof.

8. The method of claim 1, wherein the first engineered fuel is optimized for burning in a reducing environment, and where the second engineered fuel is optimized for burning in an oxidizing environment.

9. The method of claim 1, wherein at least one of the first engineered fuel and the second engineered fuel comprises one or more sorbents.

10. The method of claim 9, wherein the one or more sorbents are selected from the group consisting of sodium sesquicarbonate (Trona), sodium bicarbonate, sodium carbonate, zinc ferrite, zinc copper ferrite, zinc titanate, copper ferrite aluminate, copper aluminate, copper manganese oxide, nickel supported on alumina, zinc oxide, iron oxide, copper, copper (I) oxide, copper (II) oxide, limestone, lime, Fe, FeO, $Fe_2O_3$, $Fe_3O_4$, iron filings, $CaCO_3$, $Ca(OH)_2$, $CaCO_3.MgO$, $CaMg_2(CH_3COO)_6$, silica, alumina, china clay, kaolinite, bauxite, emathlite, attapulgite, coal ash, egg shells, Ca-montmorillonite, calcium magnesium acetate, calcium acetate, calcium formate, calcium benzoate, calcium propionate, and magnesium acetate, and mixtures thereof.

11. The method of claim 9, wherein the first engineered fuel comprises one or more sorbents, and wherein said cogasifying is carried out at a temperature above the sintering temperature of the one or more sorbents.

12. The method of claim 1, wherein the cofiring step comprises one of direct cofiring and indirect cofiring.

13. The method of claim 1, wherein the combustor is a boiler, wherein cofiring comprises:

combusting the second engineered fuel and the second fossil fuel in a combustion zone of the boiler; and combusting the syngas in a reburn zone of the boiler.

14. A combustion system, comprising:

a gasifier for receiving a first engineered fuel and a first fossil fuel at a first cofiring ratio, said gasifier operable for cogasifying the first engineered fuel and the first fossil fuel to produce syngas;

a combustor for receiving a second engineered fuel and a second fossil fuel at a second cofiring ratio, said combustor further receiving the syngas from the gasifier, said combustor operable for cofiring the second engineered fuel, the second fossil fuel, and the produced syngas; and wherein the combustion system is operable to vary an overall cofiring ratio of the combustion system by varying an input characteristic of at least two of the first engineered fuel, the first fossil fuel, the second engineered fuel, and the second fossil fuel, wherein the first cofiring ratio and the second cofiring ratio are unchanged.

15. The system of claim 14, wherein the varied input characteristic is one of weight, weight per unit time, heat value, and heat value per unit time.

16. The system of claim 14, wherein the overall cofiring ratio is in a range from about 10% to about 50%.

17. The system of claim 14, wherein the second cofiring ratio is in a range from about 5% to about 20%.

18. The system of claim 14, wherein the first cofiring ratio is in a range from about 30% to about 70%.

19. The system of claim 14, wherein the fossil fuel comprises one or more variety of coal.

20. The system of claim 19, wherein the one or more variety of coal is selected from the group consisting of: anthracite, lignite, bituminous coal and mixtures thereof 21. The system of claim 14, wherein the first engineered fuel is optimized for burning in a reducing environment, and where the second engineered fuel is optimized for burning in an oxidizing environment.

22. The system of claim 14, wherein at least one of the first engineered fuel and the second engineered fuel comprises one or more sorbents.

23. The system of claim 22, wherein the one or more sorbents is selected from the group consisting of sodium sesquicarbonate (Trona), sodium bicarbonate, sodium carbonate, zinc ferrite, zinc copper ferrite, zinc titanate, copper ferrite aluminate, copper aluminate, copper manganese oxide, nickel supported on alumina, zinc oxide, iron oxide, copper, copper (I) oxide, copper (II) oxide, limestone, lime, Fe, FeO, $Fe_2O_3$, $Fe_3O_4$, iron filings, $CaCO_3$, $Ca(OH)_2$, $CaCO_3.MgO$, $CaMg_2(CH_3COO)_6$, silica, alumina, china clay, kaolinite, bauxite, emathlite, attapulgite, coal ash, egg shells, Ca-montmorillonite, calcium magnesium acetate, calcium acetate, calcium formate, calcium benzoate, calcium propionate, and magnesium acetate, and mixtures thereof.

24. The system of claim 14, wherein the first engineered fuel comprises one or more sorbents, and wherein the gasifier carries out the cogasifying at a temperature above the sintering temperature of the one or more sorbents.

25. The system of claim 14, wherein the combustor may be directly or indirectly cofired.

26. The system of claim 14, wherein the combustor is a boiler, wherein the boiler is operable for combusting the second engineered fuel and the second fossil fuel in a combustion zone of the boiler, and wherein the boiler is further operable for combusting the syngas in a reburn zone of the boiler.

* * * * *